US005456654A

United States Patent [19]

Ball

[11] Patent Number: 5,456,654

[45] Date of Patent: Oct. 10, 1995

[54] IMPLANTABLE MAGNETIC HEARING AID TRANSDUCER

[76] Inventor: Geoffrey R. Ball, 754 Chemova Ct., Sunnyvale, Calif. 94087

[21] Appl. No.: 87,618

[22] Filed: Jul. 1, 1993

[51] Int. Cl.[6] ..... H04R 25/00

[52] U.S. Cl. ..... 600/25; 607/57; 381/69

[58] Field of Search ..... 600/25; 181/126–137; 381/68–69.2; 607/55–57

[56] References Cited

U.S. PATENT DOCUMENTS

| | | | |
|---|---|---|---|
| 3,764,748 | 10/1973 | Branch et al. | 179/107 E |
| 3,870,832 | 3/1975 | Fredrickson | 179/107 E |
| 3,882,285 | 5/1975 | Nunley et al. | 179/107 E |
| 4,063,048 | 12/1977 | Kissiah, Jr. | 179/107 R |
| 4,063,049 | 12/1977 | Pipitone et al. | 179/110 A |
| 4,606,329 | 8/1986 | Hough | 128/1 R |
| 4,611,598 | 9/1986 | Hortmann et al. | 128/419 R |
| 4,612,915 | 9/1986 | Hough et al. | 128/1 R |
| 4,628,907 | 12/1986 | Epley | 128/1.6 |
| 4,728,327 | 3/1988 | Gersdorff | 623/10 |
| 4,756,312 | 7/1988 | Epley | 128/420.5 |
| 4,776,322 | 10/1988 | Hough et al. | 128/1.6 |
| 4,800,884 | 1/1989 | Heide et al. | 128/419 R |
| 4,817,607 | 4/1989 | Tatge | 128/419 R |
| 4,817,609 | 4/1989 | Perkins et al. | 128/420.6 |
| 4,840,178 | 6/1989 | Heide et al. | 128/419 R |
| 4,936,305 | 6/1990 | Ashtiani et al. | 128/420.6 |
| 4,969,900 | 11/1990 | Fleischer | 623/10 |
| 4,988,333 | 1/1991 | Engebretson et al. | 600/25 |
| 5,015,224 | 5/1991 | Maniglia | 600/25 |
| 5,015,225 | 5/1991 | Hough et al. | 600/25 |
| 5,085,628 | 2/1992 | Engebretson et al. | 600/25 |
| 5,163,957 | 11/1992 | Sade' et al. | 623/10 |
| 5,257,623 | 11/1993 | Karasev et al. | 607/27 |
| 5,259,032 | 11/1993 | Perkins et al. | 381/68 |
| 5,259,033 | 11/1993 | Goodings et al. | 381/68 |
| 5,282,858 | 2/1994 | Bisch et al. | 623/10 |

FOREIGN PATENT DOCUMENTS

| | | | |
|---|---|---|---|
| 1440724 | 6/1976 | United Kingdom | 25/2 |

OTHER PUBLICATIONS

J. Hough et al., "A Middle Ear Implantable Hearing Device for Controlled Amplification of Sound in the Human: A Preliminary Report," Laryngoscope, 97:141–51 (1987).

N. Yanagihara et al., "Development of an Implantable Hearing Aid Using a Piezoelectric Vibrator of Bimorph Design: State of the Art," Otolaryngol Head Neck Surg, 92:706 (1984).

J. Heide et al., "Development of a Semi–Implantable Hearing Device," Adv Audiol, 4:32–43 (1988).

A. J. Maniglia et al., "Design, Development, and Analysis of a Newer Electro–Magnetic Semi–Implantable Middle Ear Hearing Device," Transplants and Implants in Otology II, pp. 365–369 (1992).

E. Lenkauskas, "Otally Implantable Hearing Aid Device," Transplants and Implants in Otology II, pp. 371–375 (1992).

J. I. Suzuki et al., "Further Clinical Experiences with Middle–Ear Implantable Hearing Aids: Indications and Sound Quality Evaluation," ORL J Otorhinolaryngol Relat Spec, 51:229–234 (1989).

(List continued on next page.)

*Primary Examiner*—Lee S. Cohen
*Assistant Examiner*—John P. Lacyk
*Attorney, Agent, or Firm*—Haverstock, Medlen & Carroll

[57] ABSTRACT

An electromagnetic transducer for improving hearing in a hearing impaired person comprises a magnet assembly and a coil secured inside a housing which is fixed to an ossicle or a middle ear. The coil is more rigidly secured to the housing than the magnet. The magnet assembly and coil are configured such that conducting alternating electrical current through the coil causes magnetic fields or the coil and the magnet assembly to cause the magnet assembly and coil to vibrate relative to one another. Because the coil is more rigidly secured to the housing than the magnet assembly, the vibrations of the coil cause the housing to vibrate. The vibrations are conducted to the oval window of the ear via the ossicles. In alternate embodiments, transducer is secured to ossicular prostheses that are secured within the middle ear.

42 Claims, 10 Drawing Sheets

OTHER PUBLICATIONS

R. L. Good, "Current Status of Electromagnetic Implantable Hearing Aids," Otolaryngologic Clinics of North America, 22:201–09 (1989).

S. C. Parisier et al., "Cochlear Implants: Indications and Technology," Medical Clinics of North America, 75:1267–76 (1991).

R. L. Goode, "Implantable Hearing Devices," Medical Clinics of North America, 75:1261–66 (1991).

B. A. Weber et al., "Application of an Implantable Bone Conduction Hearing Device to Patients with Unilateral Sensorineural Hearing Loss," Laryngoscope, 102:538–42 (1992).

E. Buchman et al., "On the Transmission of Sound Generated by an Electromagnetic Device from the Mastoid Process to the Petrous Bone," J. Acoust Soc Am, 90:895–903 (1991).

B. Häkansson et al., "Percutaneous vs. Transcutaneous Transducers for Hearing by Direct Bone Conduction," Otolaryngol Head Neck Surg, 102:339 (1990).

T. M. McGee et al., "Electromagnetic Semi–Implantable Hearing Device: Phase I. Clinical Trials," Laryngoscope, 101:355 (1991).

J. M. Kartush et al., "Electromagnetic Semi–Implantable Hearing Device: An Update," Otolaryngol Head Neck Surg. 104:150 (1991).

A. Baumfield et al., "Performance of Assistive Listening Devices Using Insertion Gain Measures," Scand Audiol, 22:43–46 (1993).

IMPLANTABLE MAGNETIC HEARING AID TRANSDUCER

FIELD OF THE INVENTION

The present invention relates to the field of devices and methods for improving hearing in hearing impaired persons and particularly to the field of implantable transducers for vibrating the bones of the middle ear.

BACKGROUND OF THE INVENTION

A schematic representation of part of the human auditory system is shown in FIG. 9. The auditory system is generally comprised of an external ear AA, a middle ear JJ, and an internal ear FF. The external ear AA includes the auditory canal BB and the tympanic membrane CC, and the internal ear FF includes an oval window EE and a vestibule GG which is a passageway to the cochlea (not shown). The middle ear JJ is positioned between the external ear and the middle ear, and includes a eustachian tube KK and three bones called ossicles DD. The three ossicles DD: the malleus LL, the incus MM, and the stapes HH, are positioned between and connected to the tympanic membrane CC and the oval window EE.

In a person with normal hearing, sound enters the external ear AA where it is slightly amplified by the resonant characteristics of the auditory canal BB of the external ear. The sound waves produce vibrations in the tympanic membrane CC, part of the external ear that is positioned at the proximal end of the auditory canal BB. The force of these vibrations is magnified by the ossicles DD.

Upon vibration of the ossicles DD, the oval window EE, which is part of the internal ear FF, conducts the vibrations to cochlear fluid (not shown) in the inner ear FF thereby stimulating receptor cells (not shown), or hairs, within the cochlea. In response to the stimulation, the hairs generate an electrochemical signal which is delivered to the brain via one of the cranial nerves and which causes the brain to perceive sound.

A number of auditory system defects will impair or prevent hearing. Some patients have ossicles that lack the resiliency necessary to increase the force of vibrations to a level that will adequately stimulate the receptor cells in the cochlea. Other patients have ossicles that are broken, and which therefore do not conduct sound vibrations to the oval window.

Prostheses for ossicular reconstruction are sometimes implanted in patients who have partially or completely broken ossicles. These prostheses are normally cut to fit snugly between the tympanic membrane CC and the oval window EE or stapes HH. The close fit holds the implants in place, although gelfoam is sometimes packed into the middle ear to ensure against loosening. Two basic forms are available: total ossicle replacement prostheses (TORPs), which are connected between the tympanic membrane CC and the oval window EE; and partial ossicle replacement prostheses (PORPs), which are positioned between the tympanic membrane and the stapes HH.

Although these prostheses provide a mechanism by which vibrations may be conducted through the middle ear to the oval window of the inner ear, additional devices are frequently necessary to ensure that vibrations are delivered to the inner ear with sufficient force to produce high quality sound perception. Even when a prosthesis is not used, disease and the like can result in hearing impairment.

Various types of hearing aids have been developed to restore or improve hearing for the hearing impaired. With conventional hearing aids, sound is detected by a microphone, amplified using amplification circuitry, and transmitted in the form of acoustical energy by a speaker or transducer into the middle ear by way of the tympanic membrane. Often the acoustical energy delivered by the speaker is detected by the microphone, causing a high-pitched feedback whistle. Moreover, the amplified sound produced by conventional hearing aids normally includes a significant amount of distortion.

Attempts have been made to eliminate the feedback and distortion problems associated with conventional hearing aid systems. These attempts have yielded devices which convert sound waves into electromagnetic fields having the same frequencies as the sound waves. A microphone detects the sound waves, which are both amplified and converted to an electrical current. The current is delivered to a coil winding to generate an electromagnetic field which interacts with the magnetic field of a magnet positioned in the middle ear. The magnet vibrates in response to the interaction of the magnetic fields, causing vibration of the bones of the middle ear or the skull.

Existing electromagnetic transducers present several problems. Many are installed using complex surgical procedures which present the usual risks associated with major surgery and which also require disarticulating (disconnecting) one or more of the bones of the middle ear. Disarticulation deprives the patient of any residual hearing he or she may have had prior to surgery, placing the patient in a worsened position if the implanted device is later found ineffective in improving the patient's hearing.

Existing devices also are incapable of producing vibrations in the middle ear which are substantially linear in relation to the current being conducted to the coil. Thus, the sound produced by these devices includes significant distortion because the vibrations conducted to the inner ear do not precisely correspond to the sound waves detected by the microphone.

An easily implantable electromagnetic transducer is therefore needed which will conduct vibrations to the oval window with sufficient force to stimulate hearing perception and with minimal distortion.

SUMMARY OF THE INVENTION

The implantable electromagnetic transducer of the present invention includes a magnet positioned inside a housing that is proportioned to be disposed in the ear and in contact with middle ear or internal ear structures such as the ossicles or the oval window. A coil is also disposed inside the housing. The coil and magnet are each connected to the housing, and the coil is more rigidly connected to the housing than the magnet.

When alternating current is delivered to the coil, the magnetic field generated by the coil interacts with the magnetic field of the magnet causing both the magnet and the coil to vibrate. As the current alternates, the magnet and the coil and housing alternately move towards and away from each other.

The vibrations produce actual side-to-side displacement of the housing and thereby vibrate the structure in the ear to which the housing is connected.

DETAILED DESCRIPTION

Figure 1:
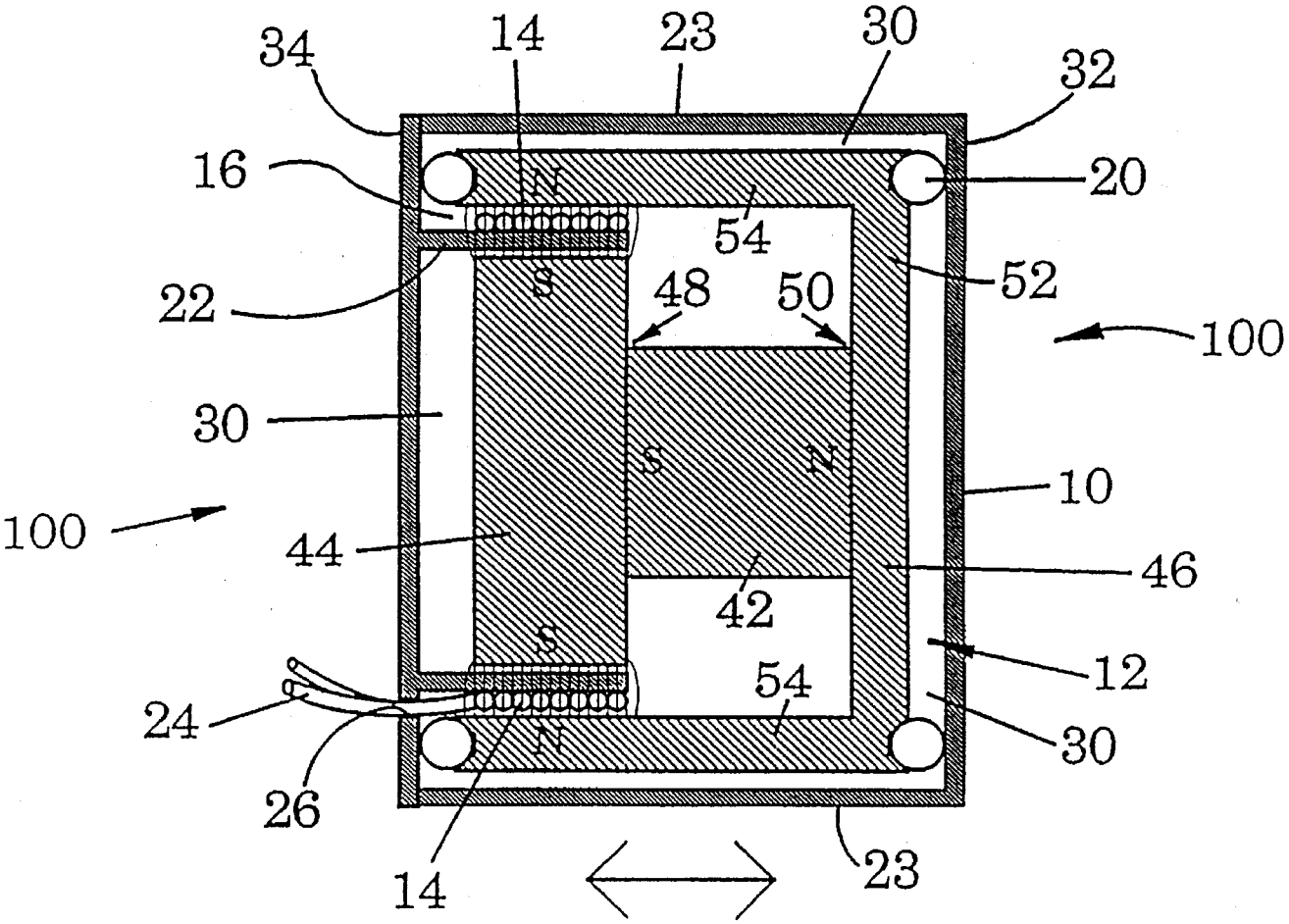
FIG. 1 is a cross-sectional side view of a transducer according to the present invention.
Figure 2:
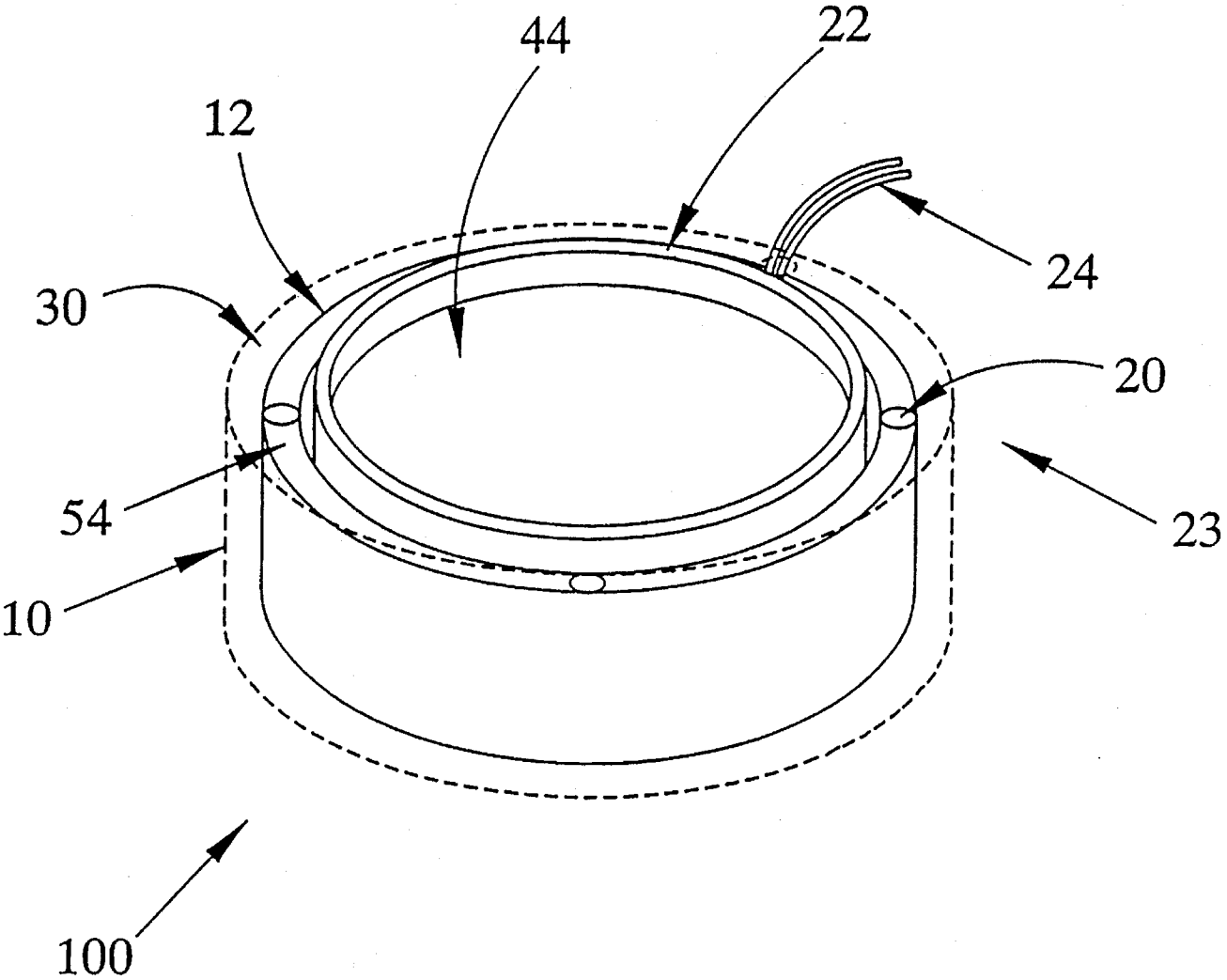
FIG. 2 is a partial perspective view of a transducer according to the present invention.

The structure of an exemplary embodiment of a transducer according to the present invention is shown in FIGS. 1 and 2. The implantable transducer 100 of the present invention is generally comprised of a sealed housing 10 having a magnet assembly 12 and a coil 14 disposed inside it. The magnet assembly is loosely suspended within the housing, and the coil is rigidly secured to the housing. As will be described, the magnet assembly 12 preferably includes a permanent magnet and associated pole pieces. When alternating current is conducted to the coil, the coil and magnet assembly oscillate relative to each other and cause the housing to vibrate.

The housing 10 is proportioned to be attached within the middle ear JJ, which comprises the malleus LL, the incus MM, and the stapes HH, collectively known as the ossicles DD, and the region surrounding the ossicles. The exemplary housing is preferably a cylindrical capsule having a diameter of 1 mm and a thickness of 1 mm, and is made from a biocompatible material, such as titanium. The housing has first and second faces 32, 34 that are substantially parallel to one another and an outer wall 23 which is substantially perpendicular to the faces 32, 34. Affixed to the interior of the housing is an interior wall 22 which defines a circular region and which runs substantially parallel to the outer wall 23.

The magnet assembly 12 and coil 14 are sealed inside the housing. Air spaces 30 surround the magnet assembly so as to separate it from the interior of the housing and to allow it to oscillate freely without colliding with the coil or housing. The magnet assembly is connected to the interior of the housing by flexible membranes such as silicone buttons

20. The magnet assembly may alternatively be floated on a gelatinous medium such as silicon gel which fills the air spaces in the housing.

A substantially uniform flux field is produced by configuring the magnet assembly as shown in FIG. 1. The assembly includes a permanent magnet 42 positioned with ends 48, 50 containing the north and south poles substantially parallel to the circular faces 32, 34 of the housing. A first cylindrical pole piece 44 is connected to the end 48 containing the south pole of the magnet and a second pole piece 46 is connected to the end 50 containing the north pole. The first pole piece 44 is oriented with its circular faces parallel to the circular faces 32, 34 of the housing 10. The second pole piece 46 has a circular face which has a rectangular cross-section and which is parallel to the circular faces 32,34 of the housing. The second pole piece 46 additionally has a pair a wall 54 which is parallel to the wall 23 of the housing and which surrounds the first pole piece 44 and the permanent magnet 42.

The pole pieces must be manufactured out of a magnetic material such as iron. They provide a path for the magnetic flux of the permanent magnet 42 which is less resistive than the air surrounding the permanent magnet 42. The pole pieces conduct much of the magnetic flux and thus cause it to pass from the second pole piece 46 to the first pole piece 44 at the gap in which the coil 14 is positioned.

For the device to operate properly, it must vibrate the ossicles with sufficient force to transfer vibrations to the cochlear fluid. The force of vibrations are best maximized by maximizing two parameters: the mass of the magnet assembly relative to the combined mass of the coil and housing, and the energy product (EP) of the permanent magnet 42.

The ratio of the mass of the magnet assembly to the combined mass of the coil and housing is most easily maximized by constructing the housing from a thinly machined, lightweight material such as titanium and by configuring the magnet assembly to fill a large portion of the space inside the housing, although there must be adequate spacing between the magnet assembly and the housing and coil for the magnet assembly to swing freely within the housing.

The magnet should preferably have a high energy product. NdFeB magnets having energy products of thirty-four and SmCo magnets having energy products of twenty-eight are presently available. A high energy product maximizes the attraction and repulsion between the magnetic fields of the coil and magnet assembly and thereby maximizes the force of the oscillations of the transducer. Although it is preferable to use permanent magnets, electromagnets may also be used in carrying out the present invention.

Figure 8:
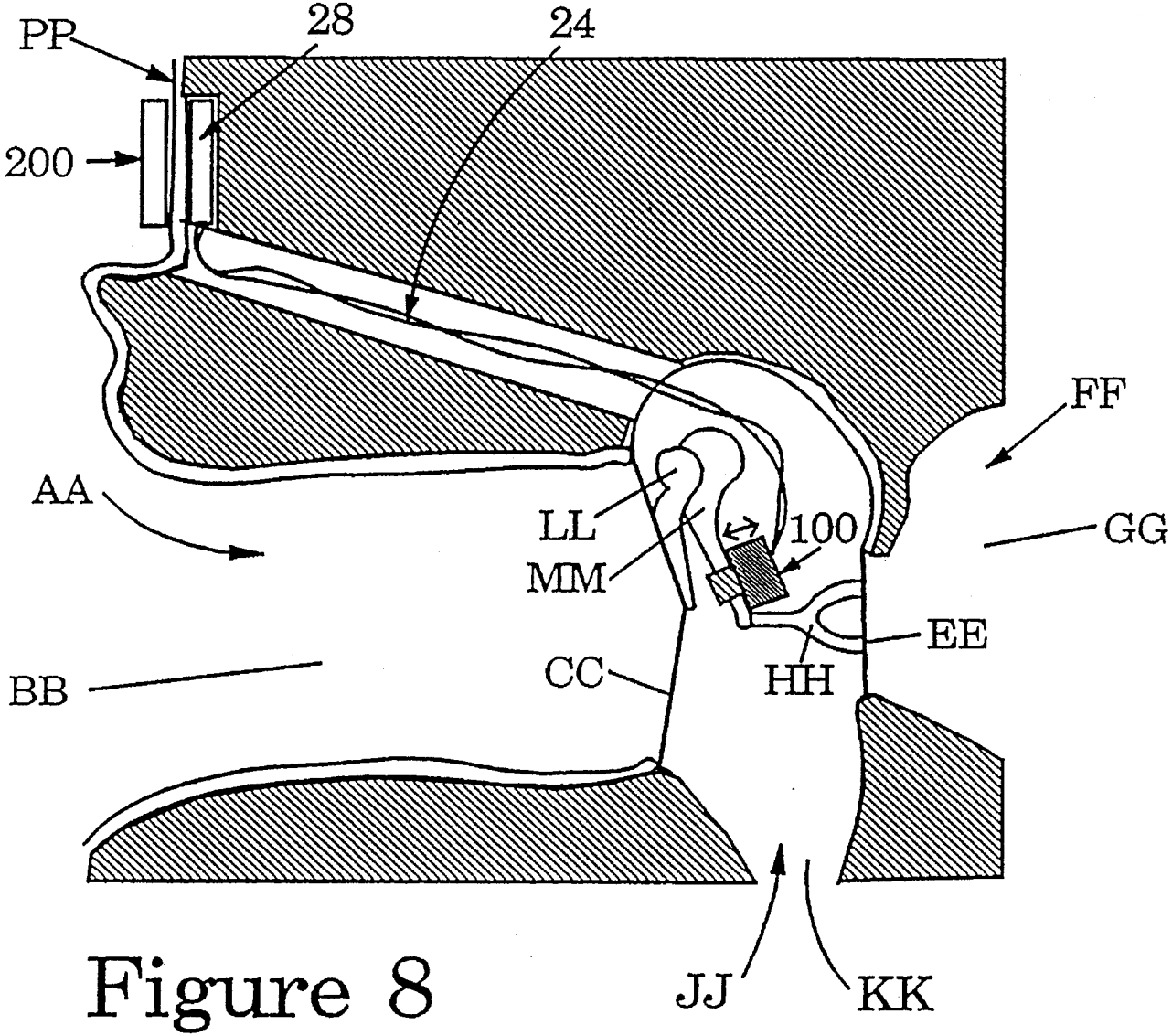
FIG. 8 is a schematic representation of a portion of the auditory system showing a transducer of the present invention positioned for receiving alternating current from a subcutaneous coil inductively coupled to an external sound transducer positioned outside a patient's head.
Figure 9:
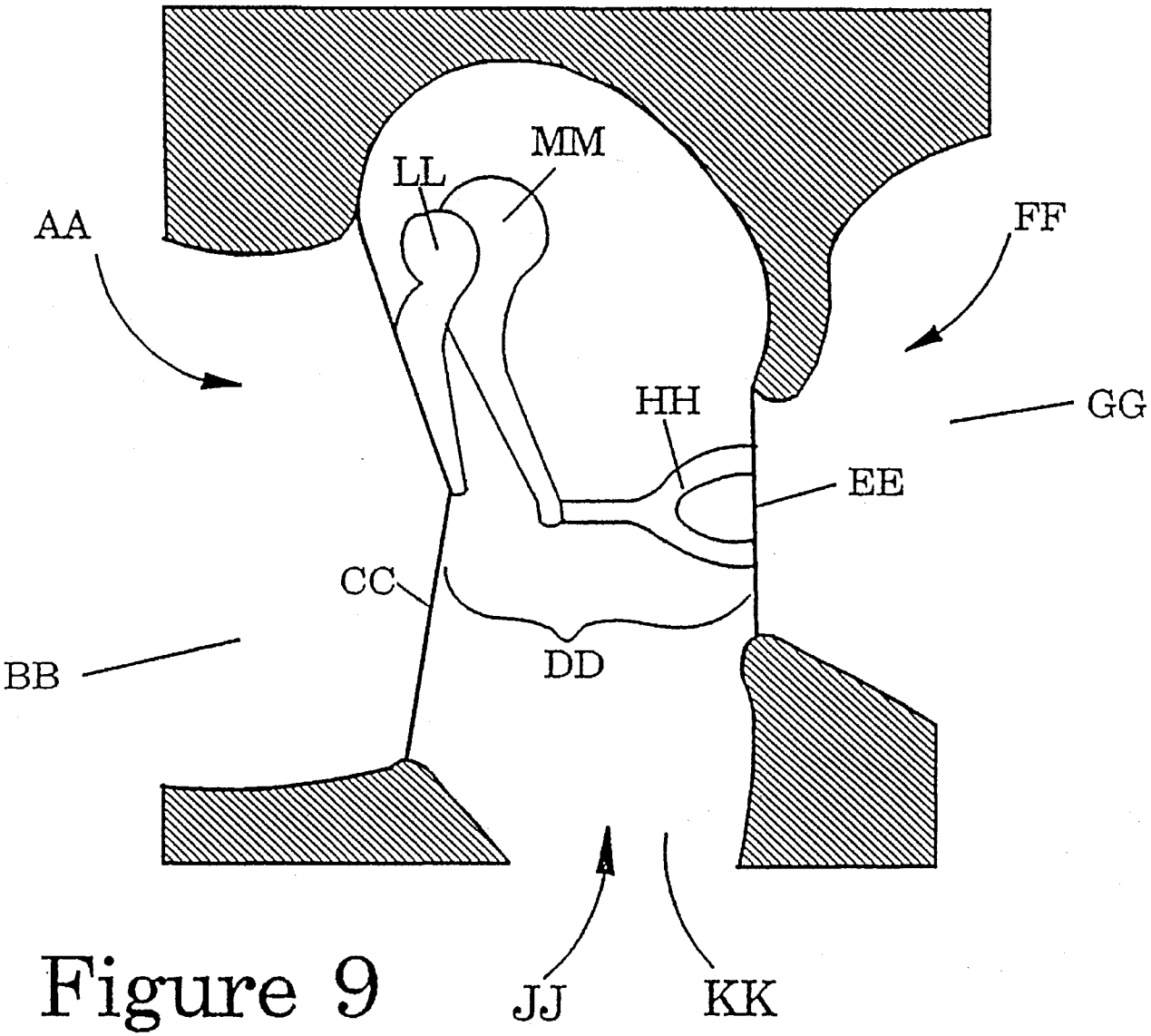
FIG. 9 is a schematic representation of a portion of the human auditory system.

The coil 14 partially encircles the magnet assembly 12 and is fixed to the interior wall 22 of the housing 10 such that the coil is more rigidly fixed to the housing than the magnet assembly. Air spaces separate the coil from the magnet assembly. A pair of leads 24 are connected to the coil and pass through an opening 26 in the housing to the exterior of the transducer and attach to a subcutaneous coil 28 (FIG. 8). The subcutaneous coil 28, which is preferably implanted beneath the skin behind the ear, delivers alternating current to the coil 14 via the leads 24. The opening 26 is closed around the leads 24 to form a seal (not shown) which prevents contaminants from entering the transducer.

The perception of sound which the vibrating transducer ultimately triggers is of the highest quality when the relationship between the displacement of the housing 10 and the current in the coil 14 is substantially linear. For the relationship to be linear, there must be a corresponding displacement of the housing for each current value reached by the alternating current in the coil. Linearity is most closely approached by positioning and maintaining the coil within the substantially uniform flux field 16 produced by the magnet assembly.

When the magnet assembly, coil, and housing are configured as in FIG. 1, alternating current in the coil causes the housing to oscillate side-to-side in the directions indicated by arrows in FIG. 1. The transducer is most efficient when positioned such that the side-to-side movement of the housing produces side-to-side movement of the oval window EE as indicated by arrows in FIG. 3*a*.

Figure 3A:
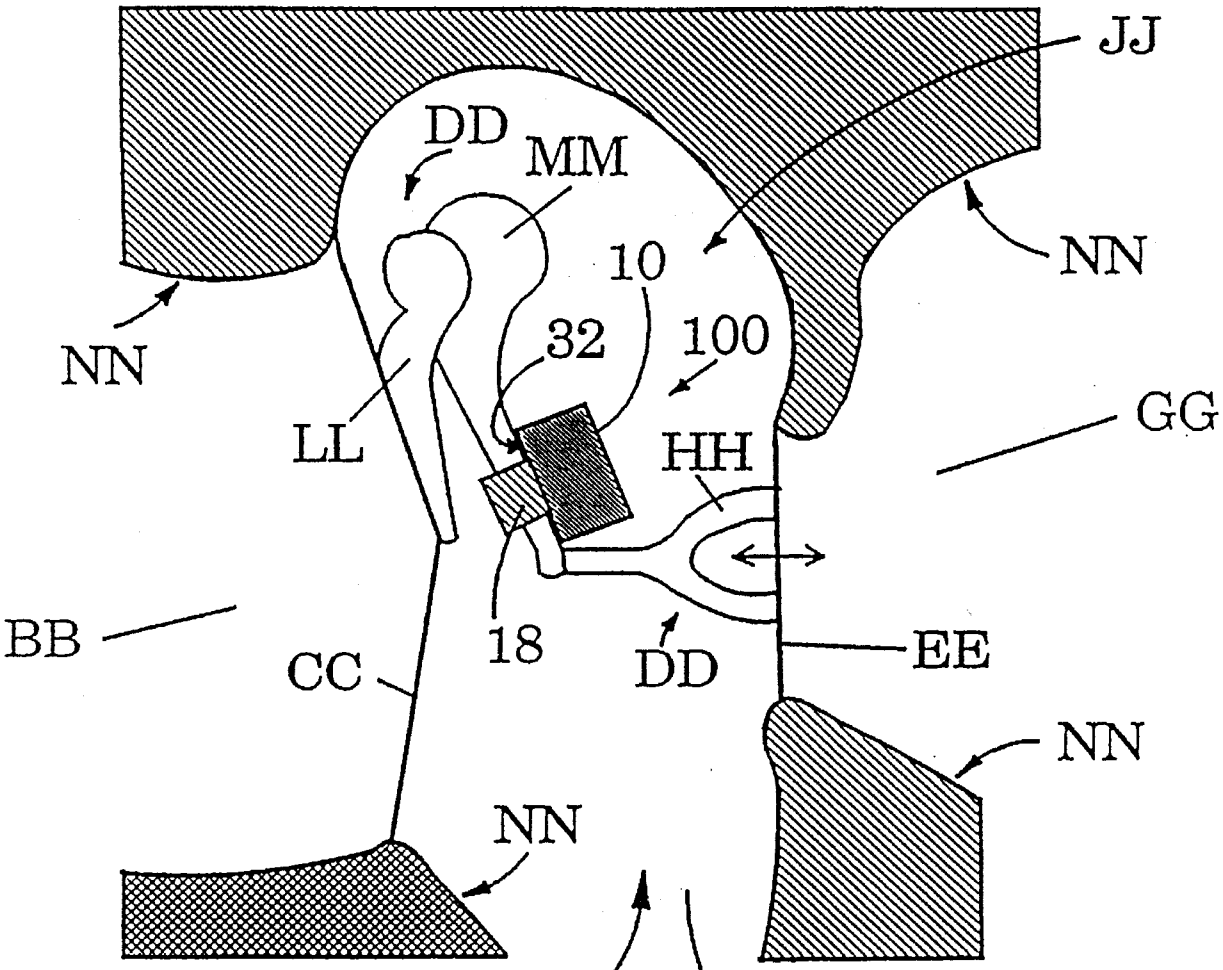
FIG. 3*a* is a schematic representation of a portion of the auditory system showing a transducer connected to a malleus of the middle ear.
Figure 3B:
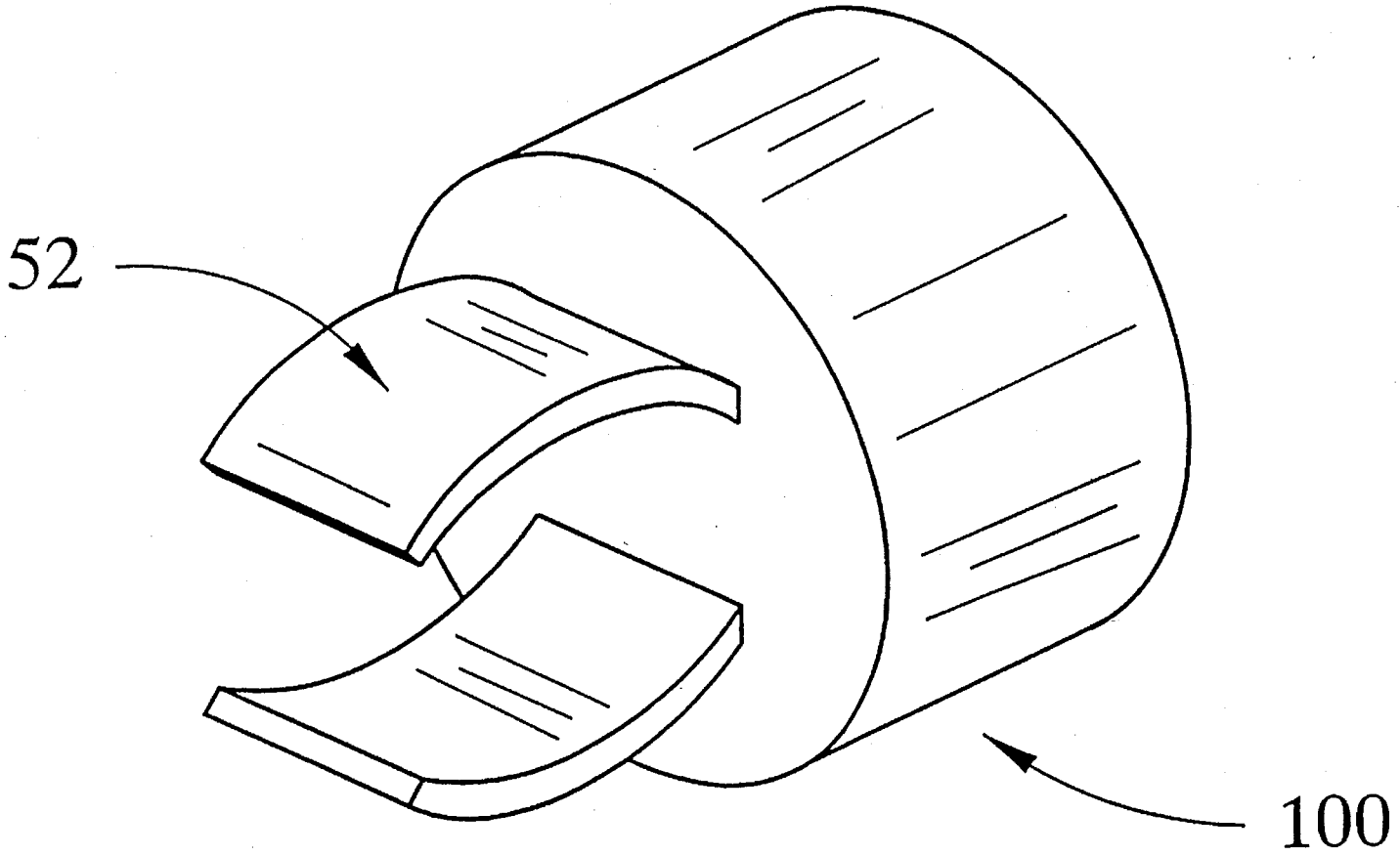
FIG. 3*b* is a perspective view of a transducer according to the present invention.

The transducer may be affixed to various structures within the ear. FIG. 3*a* shows a transducer 100 attached to an incus MM by a biocompatible clip 18 which is secured to one of the circular faces 32 of the housing 10 and which at least partially surrounds the incus MM. The clip 18 holds the transducer firmly to the incus so that the vibrations of the housing which are generated during operation are conducted along the bones of the middle ear to the oval window EE of the inner ear and ultimately to the cochlear fluid as described above. An exemplary clip 18, shown in FIG. 3*b*, includes two pairs of titanium prongs 52 which have a substantially arcuate shape and which may be crimped tightly around the incus.

The transducer 100 must be connected substantially exclusively to the ossicles DD or the oval window EE. The transducer must be mechanically isolated from the bone and tissue which surrounds the middle ear since these structures will tend to absorb the mechanical energy produced by the transducer. It is therefore preferable to secure the transducer 100 to only the ossicles DD or oval window EE and to thereby isolate it from the surrounding region NN (FIG. 3*a*). For the purposes of this description, the surrounding region consists of all structures in and surrounding the external, middle, and internal ear other than the ossicles DD, tympanic membrane CC, oval window EE and any structures connecting them with each other.

Figure 4:
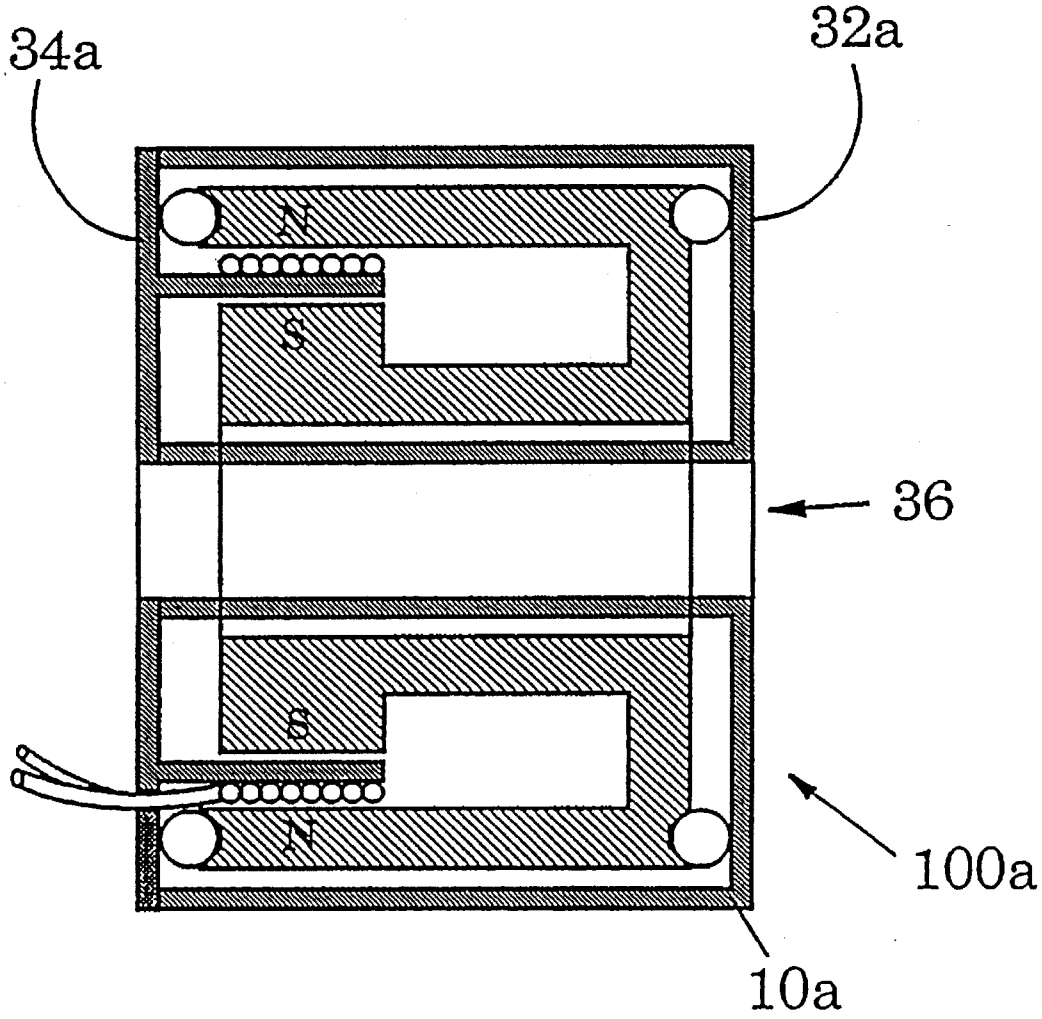
FIG. 4 is a cross-sectional side view of an alternate embodiment of a transducer according to the invention.
Figure 5:
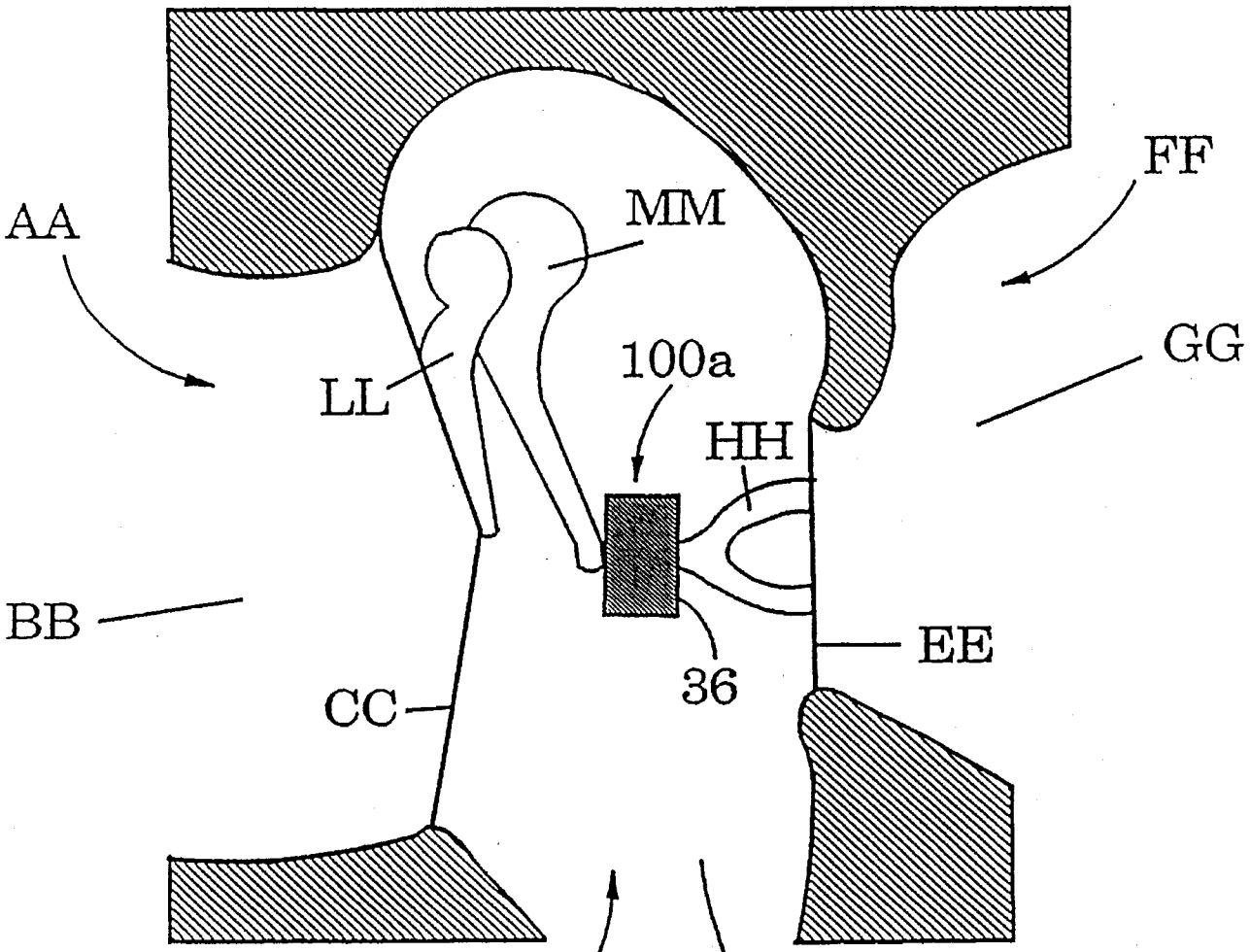
FIG. 5 is a schematic representation of a portion of the auditory system showing the embodiment of FIG. 4 positioned around a portion of a stapes of the middle ear.

An alternate transducer 100*a* having an alternate mechanism for fixing the transducer to structures within the ear is shown in FIGS. 4 and 5. In this alternate transducer 100*a*, the housing 10*a* has an opening 36 passing from the first face 32*a* to the second face 34*a* of the housing and is thereby annular shaped. When implanted, a portion of the stapes HH is positioned within the opening 36. This is accomplished by separating the stapes HH from the incus MM and slipping the O-shaped transducer around the stapes HH. The separated ossicles are then returned to their natural position, and they reconnect when the connective tissue between them heats. This embodiment may be secured around the malleus in a similar fashion.

Figure 6:
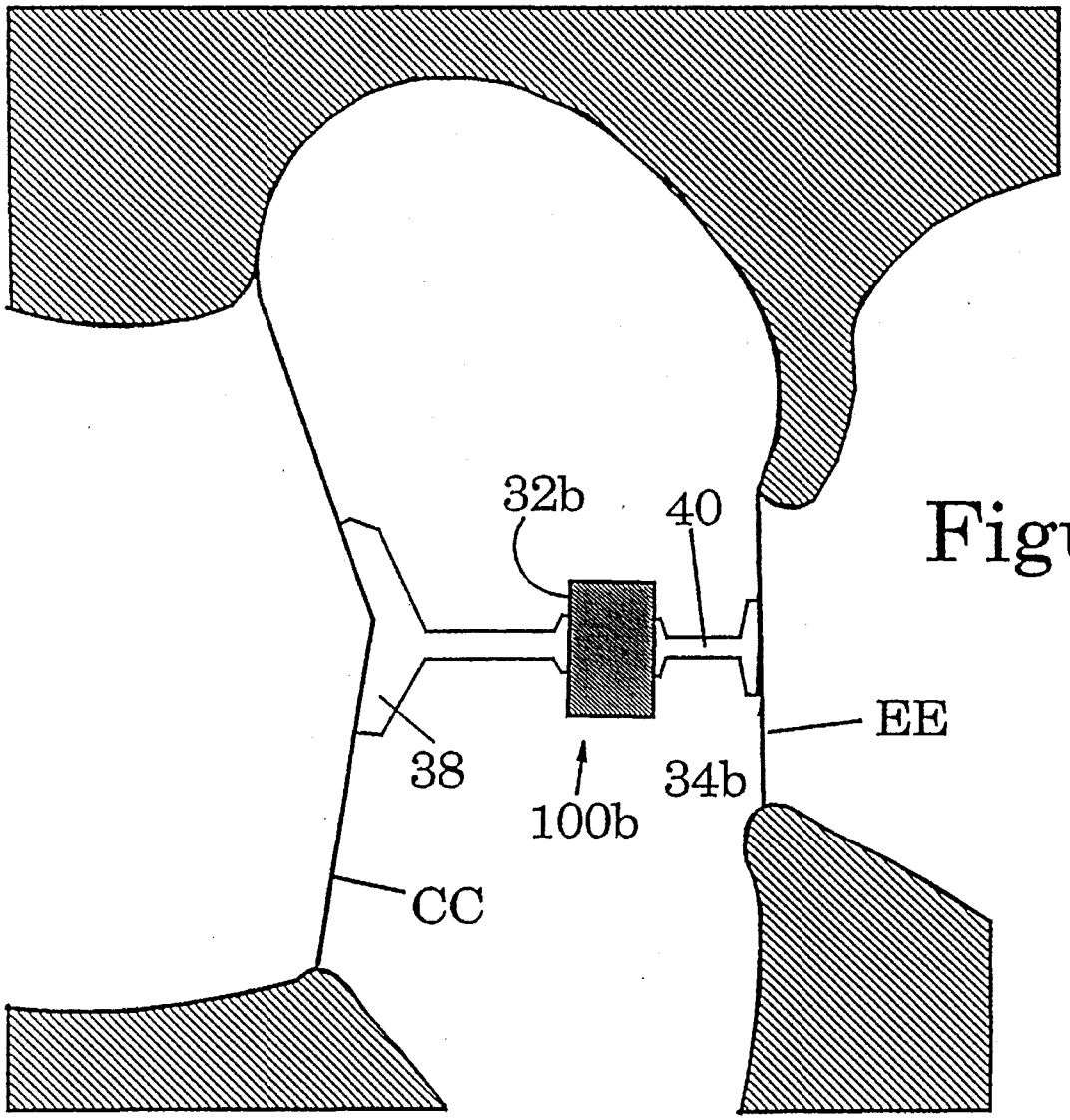
FIG. 6 is a schematic representation of a portion of the auditory system showing a transducer of the present invention and a total ossicular replacement prosthesis secured within the ear.
Figure 7:
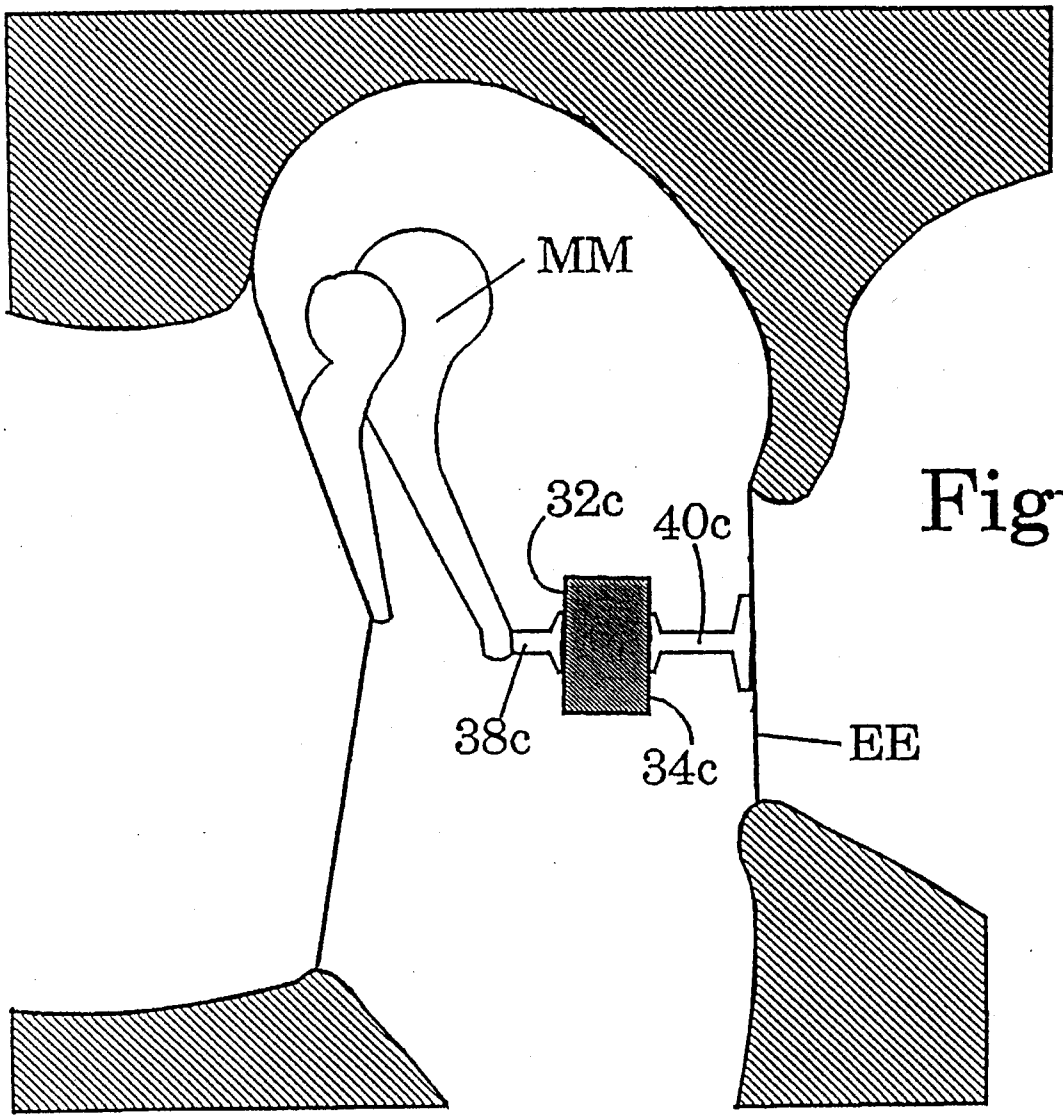
FIG. 7 is a schematic representation of a portion of the auditory system showing a transducer of the present invention and a partial ossicular replacement prosthesis secured within the ear.

FIGS. 6 and 7 illustrate the use of the transducer of the present invention in combination with total ossicular replacement prostheses (TORPs) or partial ossicular replacement prostheses (PORPS). These illustrations are merely representative; other designs incorporating the transducer into TORPs and PORPs may be easily envisioned.

TORPs and PORPs are constructed from biocompatible materials such as titanium. Often during ossicular reconstruction surgery the TORPs and PORPs are formed in the operating room as needed to accomplish the reconstruction. As shown in FIG. 6, a TORP may be comprised of a pair of members 38, 40 connected to the circular faces 32*b*, 34*b* of the transducer 100*b*. The TORP is positioned between the tympanic membrane CC and the oval window EE and is preferably of sufficient length to be held into place by friction. Referring to FIG. 7, a PORP may be comprised of a pair of members 38*c*, 40*c* connected to the circular faces 32*c*, 34*c* of the transducer positioned between the incus MM and the oval window EE.

FIG. 8 shows a schematic representation of a transducer 100 and related components positioned within a patient's skull PP. An external sound transducer 200 is substantially identical in design to a conventional hearing aid transducer and is comprised of a microphone, sound processing unit, amplifier, battery, and external coil, none of which are depicted in detail. The external sound transducer 200 is positioned on the exterior of the skull PP. A subcutaneous sound transducer 28 connected to the leads 24 of the transducer 100, is positioned under the skin behind the ear such that the external coil is positioned directly over the location of the subcutaneous coil 28.

Sound waves are detected and converted to an electrical signal by the microphone and sound processor of the external sound transducer 200. The amplifier amplifies the signal and delivers it to the external coil which subsequently delivers the signal to the subcutaneous coil 28 by magnetic induction. When the alternating current representing the sound wave is delivered to the coil 14 in the implantable transducer 100, the magnetic field produced by the coil interacts with the magnetic field of the magnet assembly 12.

As the current alternates, the magnet assembly and the coil alternately attract and repel one another and, with the alternate attractive and repulsive forces causing the magnet assembly and the coil to alternately move towards and away from each other. Because the coil is more rigidly attached to the housing than is the magnet assembly, the coil and housing move together as a single unit. The directions of the alternating movement of the housing are indicated by arrows in FIG. 8. The vibrations are conducted via the stapes HH to the oval window EE and ultimately to the cochlear fluid.

I claim:

1. An apparatus for improving hearing by generating mechanical vibrations in a middle ear, the apparatus comprising:

a sealed housing proportioned and adapted to be disposed within the middle ear;

an electrically conductive coil disposed within the housing;

a magnet assembly, including a magnet, disposed within the housing, the magnet assembly having a mass; and mounting means for mounting the coil and the magnet to the housing, wherein the coil and the magnet are arranged so as to move relative to each other when alternating current is passed through the coil, thereby causing vibration of the housing.

2. The apparatus of claim 1 further comprising conduction means adapted for conducting the vibrations to an oval window of the ear.

3. The apparatus of claim 2 wherein the conduction means comprises attachment means adapted for attaching the housing to an ossicle of the middle ear.

4. The apparatus of claim 3 wherein the attachment means includes a clip connected to the housing and gripping the ossicle.

5. The apparatus of claim 3 wherein the attachment means includes an adhesive on the housing and the ossicle.

6. The apparatus of claim 2 wherein the conduction means comprises an ossicular prosthesis attached to the housing and adapted to be positioned between a tympanic membrane and the oval window of the middle ear.

7. The apparatus of claim 2 wherein the conduction means comprises an ossicular prosthesis attached to the housing and adapted to be positioned between a tympanic membrane and an ossicle of the middle ear.

8. The apparatus of claim 2 wherein the conduction means comprises an ossicular prosthesis attached to the housing and adapted to be positioned between two ossicles of the middle ear.

9. The apparatus of claim 2 wherein the housing includes a hole passing therethrough, the hole adapted to allow an ossicle to be positioned therein such that the housing completely encircles the ossicle.

10. The apparatus of claim 1 wherein the mounting means mounts coil and magnet to the housing such that there is a linear relationship between the current in the coil and displacement of the housing.

11. The apparatus of claim 1 wherein the mounting means includes first supporting means for supporting the coil within the housing and second supporting means for supporting the magnet within the housing wherein the relative support provided by the first and second supporting means is such that the magnet is able to move more freely within the housing than the coil.

12. The apparatus of claim 11 wherein the second supporting means comprises a gelatinous medium disposed within the housing such that the magnet floats within the gelatinous medium.

13. The apparatus of claim 11 wherein the second supporting means comprises a membrane attaching the magnet to the housing.

14. The apparatus of claim 1 wherein the housing and coil have a combined mass such that the mass of the magnet assembly is higher than the combined mass.

15. The apparatus of claim 2 wherein the conduction means isolates the vibrations from the surrounding region.

16. The apparatus of claim 15 wherein the conduction means includes attachment means for attaching the housing to an ossicular prosthesis adapted to be positioned between a tympanic membrane and the oval window of the ear.

17. The apparatus of claim 15 wherein the conduction means includes attachment means for attaching the housing to an ossicular prosthesis adapted to be positioned between a tympanic membrane and an ossicle of the middle ear.

18. The apparatus of claim 15 wherein the conduction means includes attachment means for attaching the housing substantially exclusively between two ossicles of the middle ear.

19. The apparatus of claim 15 wherein the conduction means includes attachment means for attaching the housing substantially exclusively to an ossicle of the middle ear.

20. An apparatus for improving hearing by mechanically vibrating an ossicle in a middle ear, the apparatus comprising:

a sealed housing proportioned and adapted to be disposed in the middle ear and secured to the ossicle;

a magnet assembly, including a magnet, disposed within the housing, the magnet assembly having a mass;

an electrically conductive coil disposed within the housing, wherein the coil is configured and adapted to receive electrical current generated by a sound transducer; and mounting means for mounting the magnet and the coil to the housing such that the coil is more rigidly secured to the housing than the magnet.

21. The apparatus of claim 20 wherein the housing and coil have a combined mass such that the mass of the magnet assembly is higher than the combined mass.

22. The apparatus of claim 20 wherein the mounting means includes a membrane connecting the magnet to the housing.

23. The apparatus of claim 20 wherein the mounting means includes a gelatinous medium disposed within the housing such that the magnet floats within the gelatinous medium.

24. An apparatus for improving hearing by delivering vibrations to an oval window of an ear, the apparatus comprising:

a sealed housing;

a magnet assembly, including a magnet, disposed within the housing;

an electrically conductive coil disposed within the housing, the coil configured and adapted to receive electrical current generated by a sound transducer mounting means for mounting the magnet and the coil to the housing; and conduction means adapted for conducting vibrations from the housing to the oval window of an ear while substantially isolating the vibrations from the surrounding region.

25. The apparatus of claim 24 wherein the mounting means includes first supporting means for supporting the magnet within the housing and second supporting means for supporting the coil within the housing and wherein the relative support provided by the first and second supporting means is such that the magnet is able to move more freely within the housing than the coil.

26. The apparatus of claim 25 wherein the first supporting means housing comprises a membrane connecting the magnet to the housing.

27. The apparatus of claim 25 wherein the first supporting means comprises a gelatinous medium disposed within the housing such that the magnet floats within the gelatinous medium.

28. The apparatus of claim 24 wherein the conduction means comprises:

an ossicular prosthesis able to be secured between a tympanic membrane and an oval window of the ear; and means for securing the housing to the ossicular prosthesis.

29. The apparatus of claim 24 wherein the conduction means comprises:

an ossicular prosthesis able to be secured between a tympanic membrane and an ossicle of the ear; and means for securing the housing to the ossicular prosthesis.

30. The apparatus of claim 24 wherein the conduction means comprises:

attactment means adapted for attaching the housing substantially exclusively to an ossicle of the middle ear.

31. The apparatus of claim 30 wherein the attachment means comprises a clip secured to the housing the gripping the ossicle.

32. The apparatus of claim 30 wherein the attachment means comprises an adhesive on the housing and the ossicle.

33. The apparatus of claim 24 wherein the magnet assembly has a mass and wherein the coil and housing have a combined mass and wherein the mass of the magnet assembly is greater than the combined mass of the coil and housing.

34. An apparatus for improving hearing by producing vibrations in a middle ear, the apparatus comprising:

a sealed housing;

a magnet assembly, including a magnet, disposed within the housing, the magnet assembly generating a substantially uniform flux field;

an electrically conductive coil disposed within the housing;

mounting means for mounting the magnet and the coil within the housing such that the coil and magnet are able to move relative to each other when alternating current is passed through the coil and such that the movement of the magnet is substantially limited to within the uniform flux field and is thereby substantially linear in relation to the current in the coil.

35. A method of improving heating by oscillating an ossicle of a middle ear, comprising the steps of:

producing a first magnetic field within the middle ear using a magnet disposed within and attached to a housing secured to the ossicle; and conducting an alternating electrical current to a coil winding disposed within and attached to the housing to produce a second magnetic field which interacts with the first magnetic field, causing the housing to oscillate.

36. The method of claim 35 wherein the conducting step comprises the steps of:

detecting a sound wave having a frequency; and converting the sound wave to alternating electrical current having the same frequency as the sound wave.

37. A method of improving heating by producing mechanical vibrations within the middle ear comprising the steps of:

providing a magnet and a coil disposed within said and secured to a housing;

securing the housing substantially exclusively to a structure in the ear; and delivering an alternating current to the coil to produce relative movement of the magnet and coil and to thereby cause the housing the vibrate.

38. The method of claim 37 wherein the securing step comprises the steps of:

providing an ossicular prosthesis;

securing the housing to the prosthesis; and fixing the prosthesis between a tympanic membrane and a malleus of the ear.

39. The method of claim 37 wherein the securing step comprises the steps of:

providing an ossicular prosthesis;

securing the housing to the prosthesis; and fixing the prosthesis between a tympanic membrane and an oval window of the ear.

40. The method of claim 37 wherein the securing step comprises the steps of:

securing the housing substantially exclusively to an ossicle.

41. A method of improving hearing by delivering vibrations to an oval window of an ear, the method comprising the steps of:

(a) providing a housing, a magnet disposed within and attached to the housing, and a coil disposed within and attached to the housing, such that the coil is attached to the housing more rigidly than the magnet;

(b) detecting a sound wave having a frequency;

(c) converting the sound wave to alternating electrical current having the same frequency as the sound wave;

(d) producing a first relatively uniform magnetic field within the housing using the magnet;

(e) conducting the alternating electrical current through the coil to produce a second magnetic field;

(f) interacting the first and second magnetic fields to produce vibrations of the housing; and (g) conducting the vibrations to the oval window of the ear while substantially isolating the vibrations from surrounding regions of a middle ear.

42. The method of claim 41 wherein step (g) includes the step of securing the housing to the oval window of the ear.

* * * * *

UNITED STATES PATENT AND TRADEMARK OFFICE

CERTIFICATE OF CORRECTION

PATENT NO. : 5,456,654

DATED : October 10, 1995

INVENTOR(S) : GEOFFREY R. BALL

It is certified that error appears in the above-identified patent and that said Letters Patent is hereby corrected as shown below:

On the title page:

Item [54], please delete "MAGNETIC" and replace with "ELECTROMAGNETIC".

On the cover page, Item [54], please delete "AID".

On the cover page, Item [76], please delete "Chemova" and replace with --Chemowa--.

On the cover page, Item [56], under "OTHER PUBLICATIONS", line 14, please delete "Otally" and replace with --Totally--.

On the cover page, line 4 [57], please delete "or" and replace with --of--.

On the cover page, line 7 [57], please delete "or" and replace with --of--.

On the cover page, line 13 of block [57], after "embodiments," please insert --the--.

In column 1, line 1, please delete "MAGNETIC" and replace with "ELECTROMAGNETIC".

In column 1, line 1, please delete "AID".

In column 1, line 23, please delete ":" and replace with --,--.

In column 4, lines 16 and 17, please delete --a pair--.

In column 5, line 51, please delete "heats" and replace with --heals--.

In column 6, line 14, after "28" please insert --,--.

UNITED STATES PATENT AND TRADEMARK OFFICE

CERTIFICATE OF CORRECTION

PATENT NO. : 5,456,654

DATED : October 10, 1995

INVENTOR(S) : GEOFFREY R. BALL

It is certified that error appears in the above-identified patent and that said Letters Patent is hereby corrected as shown below:

In column 8, line 54, after "housing" please delete "the" and replace with --and--.

In column 9, line 26, please delete "heating" and replace with --hearing--.

In column 9, line 29, please delete "said".

Signed and Sealed this

Fourth Day of March, 1997

*Attest:*

*Attesting Officer*

BRUCE LEHMAN

*Commissioner of Patents and Trademarks*